US008116670B2

(12) United States Patent
Shinshi

(10) Patent No.: US 8,116,670 B2
(45) Date of Patent: Feb. 14, 2012

(54) FIXING DEVICE AND IMAGE FORMING APPARATUS USING THE SAME

(75) Inventor: Akira Shinshi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 538 days.

(21) Appl. No.: 11/979,918

(22) Filed: Nov. 9, 2007

(65) Prior Publication Data

US 2008/0112739 A1 May 15, 2008

(30) Foreign Application Priority Data

Nov. 14, 2006 (JP) ..... 2006-307954
May 10, 2007 (JP) ..... 2007-125208

(51) Int. Cl.
*G03G 15/20* (2006.01)

(52) U.S. Cl. ..... 399/329

(58) Field of Classification Search ..... 399/329, 399/122, 333, 334
See application file for complete search history.

(56) References Cited

U.S. PATENT DOCUMENTS 5,745,833 A 4/1998 Abe et al.
6,631,253 B2 * 10/2003 Nakafuji et al. ..... 399/329
6,826,382 B2 11/2004 Sanpei et al.
6,864,461 B2 3/2005 Okabayashi et al.
6,882,820 B2 4/2005 Shinshi et al.
6,958,645 B2 10/2005 Okabayashi
6,987,245 B2 1/2006 Sanpei et al.
7,109,441 B2 9/2006 Sanpei et al.
7,778,565 B2 * 8/2010 Baba et al. ..... 399/69
2002/0051659 A1 5/2002 Baba et al.
2003/0002895 A1 * 1/2003 Kato et al. ..... 399/333
2003/0185583 A1 * 10/2003 Senda ..... 399/69
2004/0013453 A1 1/2004 Shinshi et al.
2004/0184851 A1 9/2004 Otsuka et al.
2004/0228667 A1 11/2004 Eskey
2004/0265021 A1 * 12/2004 Kinouchi et al. ..... 399/334

(Continued)

FOREIGN PATENT DOCUMENTS

EP 1 014 219 6/2000

(Continued)

OTHER PUBLICATIONS

European Search Report dated Apr. 11, 2008.

(Continued)

*Primary Examiner* — David Gray
*Assistant Examiner* — Rodney Bonnette
(74) *Attorney, Agent, or Firm* — Harness, Dickey & Pierce, P.L.C.

(57) ABSTRACT

A fixing device for use in an image forming apparatus, and an image forming apparatus are disclosed. In at least one embodiment, the fixing device includes a flexible fixing member, a pressure member, an abutting member, and an interior member. The flexible fixing member is formed in an endless shape and is configured to heat and melt a toner image. The pressure member is disposed so as to be in contact with the fixing member with pressure. The abutting member is fixedly disposed on an inner surface of the fixing member so as to form a nip portion by abutting the pressure member via the fixing member. The interior member is fixedly disposed so as to face the inner surface of the fixing member except the nip portion, and is configured to heat the fixing member. The abutting member and the interior member are provided independent of each other.

26 Claims, 5 Drawing Sheets

U.S. PATENT DOCUMENTS

| | | | | |
|---|---|---|---|---|
| 2005/0129431 | A1 | 6/2005 | Oohara et al. | |
| 2005/0152721 | A1 * | 7/2005 | Kikuchi et al. | 399/333 |
| 2006/0002737 | A1 | 1/2006 | Shinshi et al. | |
| 2006/0054612 | A1 * | 3/2006 | Sanpei et al. | 219/216 |
| 2006/0056889 | A1 | 3/2006 | Higaya | |
| 2006/0127144 | A1 * | 6/2006 | Watanabe | 399/329 |
| 2006/0198672 | A1 * | 9/2006 | Kinouchi et al. | 399/334 |
| 2007/0003334 | A1 | 1/2007 | Shinshi et al. | |
| 2007/0059003 | A1 | 3/2007 | Shinshi et al. | |
| 2007/0059071 | A1 | 3/2007 | Shinshi et al. | |
| 2007/0166085 | A1 | 7/2007 | Shinshi et al. | |
| 2008/0063445 | A1 * | 3/2008 | Imai et al. | 399/333 |
| 2009/0028617 | A1 * | 1/2009 | Katakabe et al. | 399/333 |

FOREIGN PATENT DOCUMENTS

| | | | |
|---|---|---|---|
| EP | 1 868 041 | | 12/2007 |
| JP | 09-185984 | | 7/1997 |
| JP | 11-002982 | | 1/1999 |
| JP | 2002-006656 | | 1/2002 |
| JP | 2003-107946 | | 4/2003 |
| JP | 2003-287969 | | 10/2003 |
| JP | 2003-287970 | | 10/2003 |
| JP | 2004-145368 | | 5/2004 |
| JP | 2006-113179 | | 4/2006 |
| WO | WO 2006011454 | A1 * | 2/2006 |
| WO | WO 2006098275 | A1 * | 9/2006 |

OTHER PUBLICATIONS

U.S. Office Action dated Apr. 5, 2011.

Office Action for corresponding Japanese patent application No. 2007-125208 dated Dec. 13, 2011.

* cited by examiner

FIXING DEVICE AND IMAGE FORMING APPARATUS USING THE SAME

PRIORITY STATEMENT

The present patent application claims priority under 35 U.S.C. §119 upon Japanese Patent Applications No. JP2006-307954 filed on Nov. 14, 2006 and No. JP 2007-125208 filed on May 10, 2007 in the Japan Patent Office, the entire contents of each of which are hereby incorporated herein by reference.

BACKGROUND

An image forming apparatus used as a printer, facsimile machine, copier, or multi-functional device thereof may use a fixing member to fix a toner image on a recording medium. Such a fixing member may be a fixing belt, film, or roller, for example.

For example, a conventional image forming apparatus may include a fixing belt having an endless shape, a plurality of roller members for extending and supporting the fixing belt, a heater provided inside one of the plurality of roller members, and a pressure roller serving as a pressure member. When the fixing belt is heated by the heater via the one roller member, a recording medium having a toner image thereon is conveyed to a nip formed between the fixing belt and the pressure roller. When heat and pressure are applied to the recording medium at the nip, the toner image is fixed on the recording medium.

Another conventional image forming apparatus uses an on-demand fixing device operable with a relatively short warm-up time. Such an on-demand fixing device may include an endless fixing film serving as a fixing member, a pressure roller serving as a pressure member, and a heater, for example, a ceramic heater. The heater is disposed at an inner surface side of the fixing film to heat the fixing film. The heater also forms a nip by abutting the pressure roller via the fixing film. When a recording medium is conveyed to the nip, heat and pressure are applied to a toner image on the recording medium at the nip and thus the toner image is fixed on the recording medium.

The belt-type fixing device as described above is relatively advantageous in increasing its operation speed compared to a roller-type fixing device. However, such belt-type fixing device may not be so effective to shorten so called "warm-up time," which is the time required to reach a temperature suitable for operation, and "first print time," which is the time required for completing a print operation starting from receipt of a print request, printing, and ejection of a printed medium.

On the other hand, for the on-demand fixing device using a fixing film, the warm-up time and first print time may be shortened by reducing a heat capacity thereof, thereby reducing the size thereof. However, in the on-demand fixing device, only the nip of the fixing film is locally heated while the other portions may be not sufficiently heated. As a result, during rotation, the fixing film may have a relatively low temperature at the sheet entry side of the nip, thereby causing defective fixing. Further, when the fixing device is operated at higher speed, the fixing film is also rotated at higher speed, thereby further facilitating heat dissipation at the portions other than the nip.

In order to prevent such defective fixing, a tubular metal heat conductor may be provided so as to face an inner surface of an endless fixing member. By directly or indirectly heating the metal heat conductor, the entire portion of the fixing member may be sufficiently and uniformly heated.

However, in such a configuration, the tubular metal heat conductor might be undesirably deformed by pressing force, which is applied at the nip from the pressure member to the metal heat conductor. Because the tubular metal heat conductor has been preferably formed thinner in order to enhance the heat efficiency of the fixing member, such a configuration may more easily cause defective fixing.

Deformation of the metal heat conductor may cause severe rubbing against the inner surface of the fixing member at the deformed portion. As a result, the inner surface of the fixing member may be unevenly worn out, thereby deteriorating the durability thereof. Alternatively, a driving torque of the fixing member may be increased, thereby causing slip of the fixing member and jam of a recording medium at the nip.

The deformation of the metal heat conductor may also reduce its contact area with the pressure member on a central portion in a width direction thereof. As a result, the nip width of the deformed portion may become smaller than the nip width of each end portion of the metal heat conductor. In such state, the amount of heat which the metal heat conductor applies to the recording medium is different between the central portion and each end portion. Consequently, cold offset may be caused at a central portion of an output image, while hot offset may be caused at end portions thereof. Thus, a relatively large difference in glossiness may occur between the central portion and the respective end portions. Further, an extremely large deviation in nip width may occur between the central portion and each end portion. Such deviation may significantly affect the output image and, in some cases, might cause cockling in the recording medium.

SUMMARY

The present disclosure provides an image forming apparatus and a fixing device operable while suppressing defective fixing and/or other failures even when the image forming apparatus and/or the fixing device operates at a relatively high speed with a shortened warm-up time and first print time.

In at least one example embodiment of the present specification, a fixing device for use in an image forming apparatus includes a flexible fixing member, a pressure member, an abutting member, and an interior member. The flexible fixing member is formed in an endless shape and is configured to heat and melt a toner image. The pressure member is disposed so as to be in contact with the fixing member with pressure. The abutting member is fixedly disposed on an inner surface of the fixing member so as to form a nip portion by abutting the pressure member via the fixing member. The interior member is fixedly disposed so as to face the inner surface of the fixing member except the nip portion, and is configured to heat the fixing member. The abutting member and the interior member are provided independent of each other.

BRIEF DESCRIPTION OF THE DRAWINGS

A more complete appreciation of the subject matter of this disclosure and many of the attendant advantages thereof will be readily obtained as the same becomes better understood by reference to the following detailed description when considered in connection with the accompanying drawings, wherein.

Figure 1:
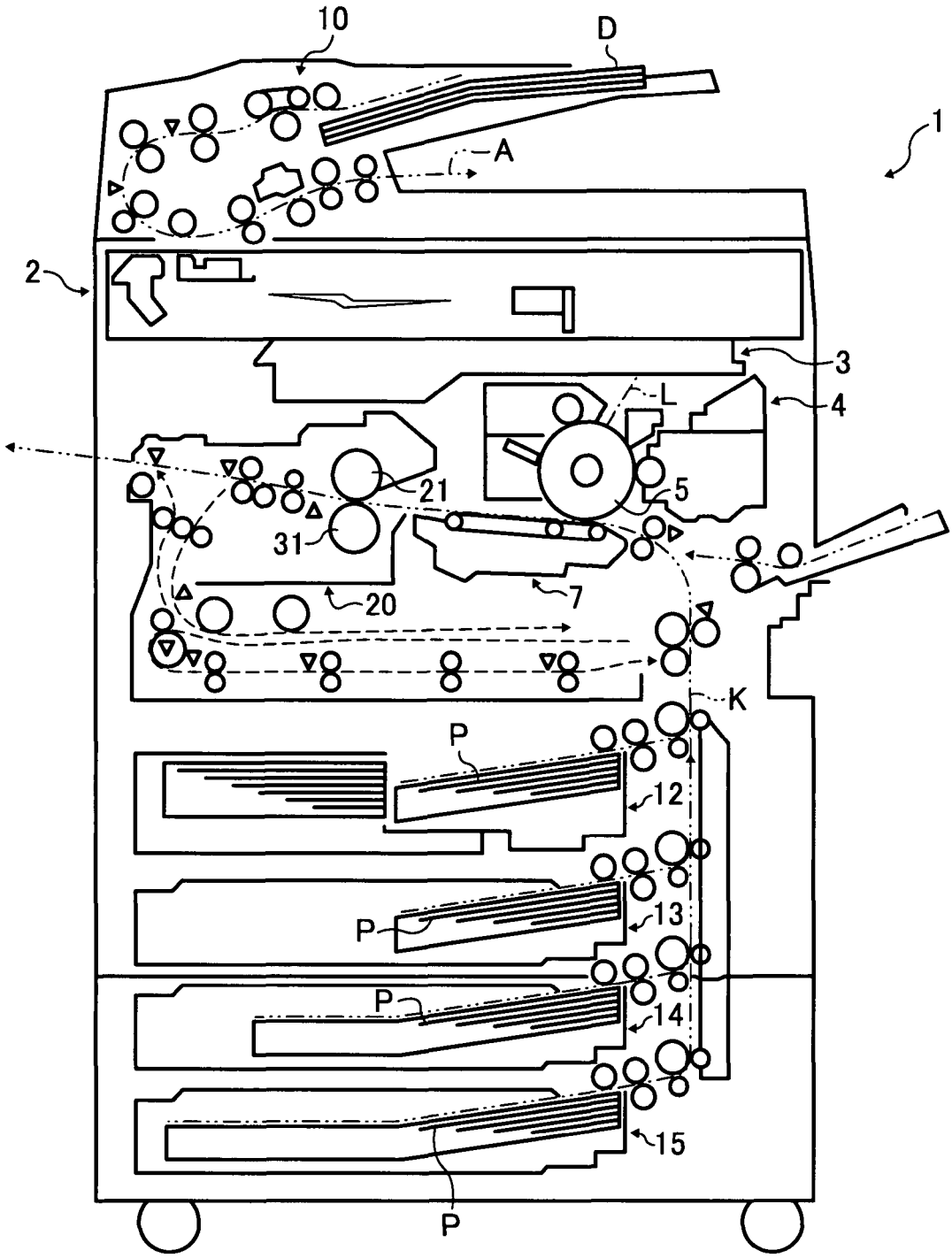
FIG. 1 is a schematic view illustrating an overall configuration of an image forming apparatus according to an example embodiment.

The accompanying drawings are intended to depict example embodiments of the present disclosure and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like may be used herein to facilitate description of one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors herein interpreted accordingly.

Although the terms first, second, etc., may be used herein to describe various elements, components, regions, layers, and/or sections, it should be understood that these elements, components, regions, layers, and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to limit the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity, the same reference numerals are used in the drawings and the descriptions for the same materials and constituent parts having the same functions, and descriptions thereof are omitted unless otherwise stated.

Example embodiments of the present disclosure are now described below with reference to the accompanying drawings. It should be noted that, in a later-described comparative example, example embodiment, and alternative example, the same reference numerals are used for the same constituent elements such as parts and materials having the same functions, and descriptions thereof omitted.

First, an image forming apparatus according to an example embodiment is described with reference to FIG. 1.

FIG. 1 is a schematic view of a configuration of an image forming apparatus 1. In this example embodiment, the image forming apparatus 1 is configured as a monochrome multifunctional copier. However, an image forming apparatus according to an example embodiment is not limited to the multifunctional copier, but may be a copier, a printer, a facsimile, or any other suitable type of multifunctional device having functions thereof.

As illustrated in FIG. 1, the image forming apparatus 1 includes a document reading unit 2, an exposing unit 3, an imaging unit 4 including a photoconductor drum 5, a transfer unit 7, a document conveying unit 10, sheet feeding units 12 to 15, and a fixing device 20, for example.

The document reading unit 2 optically reads image information of an original document D. The exposing unit 3 irradiates exposure light L onto the photoconductor drum 5 according to the image information read in the document reading unit 2. The imaging unit 4 forms a toner image on the photoconductor drum 5. The transfer unit 7 transfers the toner image onto a recording medium P. The document conveying unit 10 conveys the document D to the document reading unit 2. Each of the sheet feeding units 12 to 14 accommodates a stack of recording media P, for example, transfer sheets. The fixing device 20 fixes an unfixed image transferred on the recording medium P. In this example embodiment, the fixing device 20 is provided with a fixing belt 21 serving as a fixing member and a pressure roller 31 serving as a pressure member.

Next, a normal image-forming operation of the image forming apparatus 1 is described with reference to FIG. 1. An original document D on a document table is conveyed using conveyance rollers of the document conveying unit 10 in a direction indicated by an arrow A in FIG. 1, and is passed over the document reading unit 2. Meanwhile, the document reading unit 2 optically reads image information of the original document D.

The image information optically read by the document reading unit 2 is converted into electric signals and is transmitted to the exposing unit 3 or an optical writing unit. Based on the electric signals of image information, the exposing unit 3 irradiates exposure light L, for example, a laser beam onto the photoconductor drum 5 of the imaging unit 4.

Meanwhile, in the imaging unit 4, the photoconductor drum 5 is rotated in the clockwise direction in FIG. 1. Through imaging processes including charging, exposing, and developing processes, a toner image corresponding to the image information is formed on the photoconductor drum 5. The transfer unit 7 transfers the toner image from the photoconductor drum 5 onto a recording medium P conveyed by registration rollers.

In this regard, the recording medium P is conveyed to the transfer unit 7 as follows. One of the sheet feeding units 12 to 14 of the image forming apparatus 1 is automatically or manually selected. Here, for example, assume that the topmost sheet feeding unit 12 is selected. A topmost sheet of a stack of recording media P accommodated in the sheet feeding unit 12 is conveyed to an entrance of a conveyance path K.

When the recording medium P is conveyed to the registration rollers through the conveyance path K, the registration rollers feed the recording medium P toward the transfer unit 7. The registration rollers feed the recording medium P in such a timing that the toner image formed on the photoconductor drum 5 is properly transferred on the recording medium P.

The recording medium P is passed over the transfer unit 7 and is further conveyed along the conveyance path K to the fixing device 20. When the recording medium P is sent into a nip between the fixing belt 21 and the pressure roller 31, the toner image is fixed on the recording medium P by heat of the fixing belt 21 and pressure of the fixing belt 21 and the pressure roller 31. The recording medium P having the toner image fixed thereon is sent out from the nip between the fixing belt 21 and the pressure roller 31, and ejected from the image forming apparatus 1. Thus, a series of image forming processes is performed.

Figure 2:
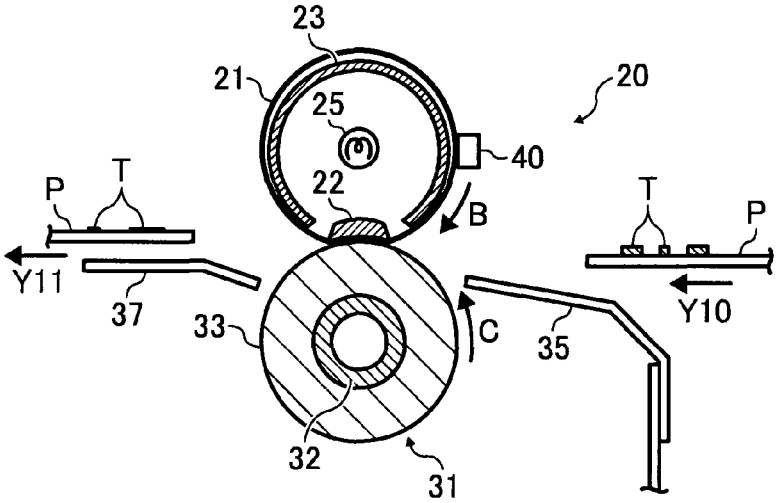
FIG. 2 is a schematic view illustrating a fixing device according to an example embodiment.
Figure 3:
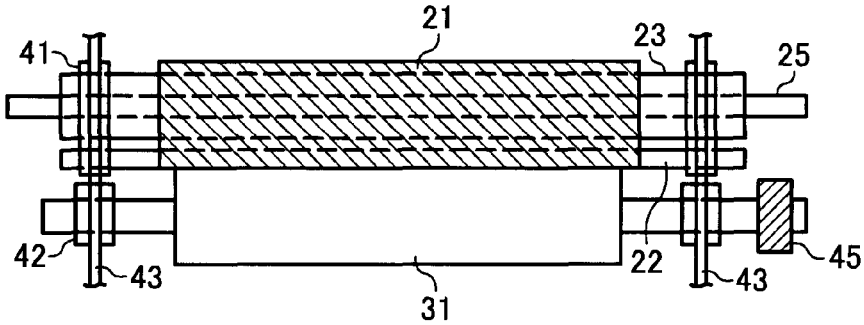
FIG. 3 is a schematic view of the fixing device of FIG. 2 viewed from a width direction side.
Figure 4:
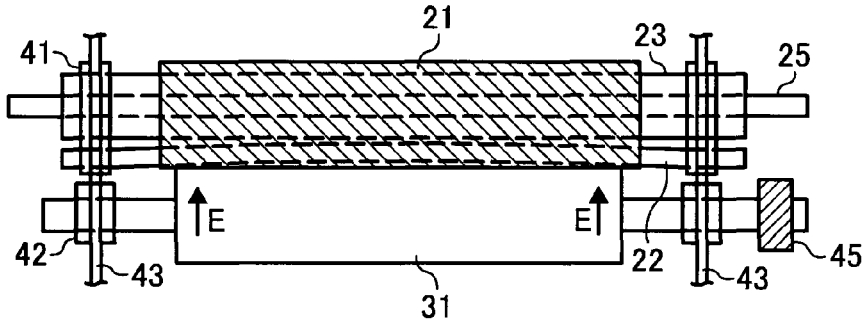
FIG. 4 is a bent state of an abutting member.

Next, a configuration and a fixing operation of the fixing device 20 are described in further detail with reference to FIGS. 2 to 4. FIG. 2 is a schematic view illustrating a configuration of the fixing device 20. FIG. 3 is a schematic view in the width direction of the fixing device 20.

As illustrated in FIG. 2, the fixing device 20 includes a fixing belt 21 serving as a fixing member, an abutting member 22, an interior member 23, a heater 25 serving as a heat source, a pressure roller 31 serving as a pressure member, a temperature sensor 40, a guide plate 35, and a guide plate 37, for example.

Here, the fixing belt 21 is a thin, flexible endless belt and is rotated in the clockwise direction indicated by an arrow B in FIG. 2. The fixing belt 21 may include a substrate and additionally an elastic layer and a releasing layer, which are laminated in order on the substrate. The fixing belt 21 may be formed in a total thickness of 1 mm or less, for example.

The substrate of the fixing belt 21 has a thickness of approximately 30 to 50 μm, for example and is made of nickel, stainless steel, or any other suitable metal and/or polyimide or any other suitable resin.

The elastic layer of the fixing belt 21 has a thickness of approximately 100 to 300 μm, for example, and is made of silicone rubber, silicone rubber foam, fluorocarbon rubber, or any other suitable rubber material. By providing the fixing belt 21 with the elastic layer, minute irregularities may be prevented from being formed on the surface of the fixing belt 21 at the nip. As a result, heat of the fixing belt 21 can be uniformly applied over a toner image T, which may prevent formation of a defective image, for example, a so-called orange peel image.

The releasing layer of the fixing belt 21 has a thickness of approximately 10 to 50 μm, for example, and is made of tetrafluoroethylene-perfluoroalkylvinylether copolymer resin (PFA), polyimide, polyetherimide, polyethersulfide (PES), or any other suitable material. By providing the fixing belt 21 with the releasing layer, the fixing belt 21 may be securely released or separated from the toner image T.

The fixing belt 21 is configured to have a diameter in a range from 15 to 120 mm, for example. In this example embodiment, the diameter of the fixing belt 21 is assumed to be 30 mm.

The heater 25, the abutting member 22, and the interior member 23 are fixedly disposed at the inner surface side of the fixing belt 21. The fixing belt 21 is in contact with the abutting member 22 with pressure to form the nip between the fixing belt 21 and the pressure roller 31.

The abutting member 22 is fixedly disposed at the inner surface side of the fixing belt 21 so as to form the nip by abutting the pressure roller 31 via the fixing belt 21. As illustrated in FIG. 3, the abutting member 22 is fixedly supported at end portions in a width direction thereof by side plates 43 of the fixing device 20 via support members 41. Further, as illustrated in FIG. 2, the abutting member 22 has a face opposite to the pressure roller 31, which is formed to have a curvature similar to, if not same as, that of the pressure roller 31. Thus, the recording medium P is sent out from the nip along a curved surface of the pressure roller 31. Such a configuration may prevent the recording medium P from remaining unseparated from and attracted on the fixing belt 21 after the fixing process.

The abutting member 22 is preferably made of material having such a rigidity as not to be severely bent by a pressing force of the pressure roller 31. The abutting member 22 has a sliding contact face to slidingly contact the fixing belt 21. The sliding contact face is preferably made of material having a relatively low friction coefficient so as to suppress abrasion of the fixing belt 21 during sliding contact.

The heater 25 serving as a heat source is a halogen heater, a carbon heater, or any other suitable heater. As illustrated in FIG. 3, the heater 25 has end portions fixed on the side plates 43 of the fixing device 20 via the support members 41.

The interior member 23 is heated by radiation heat radiated from the heater 25, the output of which is controlled by a power supply of the image forming apparatus 1. The fixing belt 21 is entirely heated except the nip by the interior member 23. From the outer surface of the fixing belt 21 thus heated, heat is transmitted onto the toner image T carried on the recording medium P. The output control of the heater 25 is performed based on detection results of the surface temperature of the fixing belt 21 detected by the temperature sensor 40, for example, a thermistor. As illustrated in FIG. 2, the temperature sensor 40 is disposed at a position opposite to the outer surface of the fixing belt 21. By performing the output control of the heater 25 as described above, the surface temperature of the fixing belt 21, i.e., fixing temperature is set to a desired temperature.

As illustrated in FIG. 2, the interior member 23 is fixedly provided so as to face the inner surface of the fixing belt 21 except the nip. The interior member 23, heated by the radiation heat of the heater 25, heats or transmits heat to the fixing belt 21. The interior member 23 may be made of heat-conductive metal, for example, aluminum, iron, or stainless steel. As illustrated in FIG. 3, the interior member 23 is fixedly supported at both end portions thereof by the side plates 43 of the fixing device 20 via the support members 41.

The gap δ between the fixing belt 21 and the interior member 23 is preferably larger than 0 mm and not larger than 1 mm. Such a configuration may suppress abrasion of the fixing belt 21 that may be caused by the sliding contact between the interior member 23 and the fixing belt 21. Such a configuration may also suppress reduction in the heating efficiency of the fixing belt 21 that may be caused by an undesirably large gap between the interior member 23 and the fixing belt 21. Further, by disposing the interior member 23 close to the fixing belt 21, a circular shape of the fixing belt 21 having a certain degree of flexibility is appropriately maintained, thereby suppressing degradation or damage of the fixing belt 21 that may be caused by deformation thereof.

As described above, the fixing device 20 according to this example embodiment is capable of effectively heating the fixing belt 21 with a relatively simple configuration. Thus, the warm-up time of the fixing device 20 and/or the first print time of the image forming apparatus 1 may be shortened while achieving the downsizing of the fixing device 20.

In this example embodiment, the abutting member 22 forming the nip and the interior member 23 heating the fixing belt 21 are provided independent of each other. In other words, each of the abutting member 22 and the interior member 23 is formed as an independent member.

As a result, without locally heating only a part of the fixing belt 21, the inner surface of the fixing belt 21 is substantially entirely heated by the interior member 23. Thus, even when the image forming apparatus 1 operates at a relatively high speed, the fixing belt 21 may be sufficiently heated, thereby suppressing defective fixing.

Alternatively, when the interior member 23 is provided independent of the abutting member 22 receiving a pressing force from the pressure roller 31, the interior member 23 may be formed in a thinner shape in order to increase the heating efficiency of the fixing belt 21, as described above. Such a configuration may suppress severe rubbing of the interior member 23 against the inner surface of the fixing belt 21 or an increased driving torque of the fixing belt 21 that might be caused by the deformation of the interior member 23. For example, as illustrated in FIG. 4, the central portion in the width direction of the abutting member 22 may be bent by pressing forces of the pressure roller 31 indicated by arrows E in FIG. 4. Even in such a case, the deformation of the abutting member 22 does not cause deformation of the interior member 23.

Further, as illustrated in FIG. 2, the abutting member 22 and the interior member 23 are disposed apart from each other. In other words, a sufficient gap is provided between the abutting member 22 and the interior member 23 so that the two members 22 and 23 do not contact each other. Such a configuration provides a space between the abutting member 22 and the interior member 23 to serve as a heat insulator, thereby suppressing reduction in the heating efficiency of the fixing belt 21 that might be caused by heat transmission from the interior member 23 to the abutting member 22. In other words, the heat, which would be otherwise transmitted to the abutting member 22, is efficiently transmitted to the fixing belt 21, thereby entirely heating the fixing belt 21 except the nip in an efficient manner.

As described above, in this example embodiment, the interior member 23 actively heats the fixing belt 21 while the abutting member 22 does not actively heat the fixing belt 21. As a result, the fixing belt 21 is sufficiently heated by the interior member 23 up to a temperature suitable for fixing before a relevant portion thereof reaches the nip. On the other hand, the nip is not actively heated and therefore a certain amount of heat of the fixing belt 21 is transmitted to the unfixed toner image T on the recording medium P, that is, consumed as an energy for melting and fixing the toner image T, thereby decreasing the temperature of the fixing belt 21. At this time, in a state where the temperature of an interface between the fixing belt 21 and an image forming surface of the recording medium P is lower than the fixing temperature, the recording medium P is sent out from the nip. As a result, while the adhesive force of toner is being reduced, the recording medium P is separated from the fixing belt 21. Thus, such a configuration that the abutting member 22 does not actively heat the fixing belt 21 may facilitate separation of the recording medium P from the fixing belt 21.

As illustrated in FIG. 2, the pressure roller 31 serving as a pressure member has a diameter of approximately 30 mm, for example. The pressure roller 31 has an elastic layer 33 formed on a hollow core metal 32. The elastic layer 33 of the pressure roller 31 is made of material, for example, fluorocarbon rubber, silicone rubber, or silicone rubber foam. On a surface of the elastic layer 33 may be provided a thin releasing layer made of PFA, polytetrafluoroethylene (PTFE), or any other suitable material. The pressure roller 31 is in contact with the fixing belt 21 with pressure to form the nip having a desired distance between the pressure roller 31 and the fixing belt 21. Further, as illustrated in FIG. 3, the pressure roller 31 may be provided with a gear 45 for engaging a driving gear of a driving mechanism, not illustrated, so as to be rotationally driven in the counterclockwise direction indicated by an arrow C in FIG. 2. The pressure roller 31 is rotatably supported at end portions in a width direction thereof by the side plates 43 via bearings 42. On the interior of the pressure roller 31 may be provided a halogen heater or any other heat source.

In this example embodiment, the fixing belt 21 is formed to have a diameter similar to, if not same as, the diameter of the pressure roller 31. However, the diameter of the fixing belt 21 may be smaller than the diameter of the processing roller 31. In such a case, the curvature of the fixing belt 21 is also smaller than the curvature of the pressure roller 31 at the nip. As a result, the recording medium P sent out form the nip may be more securely separated from the fixing belt 21.

At the entry side of the abutting portion, i.e., the nip between the fixing belt 21 and the pressure roller 31 is provided a guide plate 35, or an entry guide plate, for guiding the recording medium P to be conveyed into the nip. On the other hand, at the exit side of the nip is provided a guide plate 37, or an exit guide plate, for guiding the recording medium P sent out from the nip. The guide plates 35 and 37 are fixedly provided on the side plates 43 of the fixing device 20.

Next, an operation of the fixing device 20 configured as described above is briefly described.

When the image forming apparatus 1 is powered on, an electric power is supplied to the heater 25 and the pressure roller 31 is rotationally driven in the direction indicated by the arrow C in FIG. 2. By a frictional force generated between the pressure roller 31 and the fixing belt 21, the fixing belt 21 is dependently driven or rotated in the direction indicated by the arrow B in FIG. 2.

When a recording medium P is fed from one of the sheet feeding units 12 to 14, an unfixed toner image T is carried on the recording medium P at the imaging unit 4. While being guided by the guide plate 35, the recording medium P having the unfixed toner image T thereon is conveyed in a direction indicated by an arrow Y10 in FIG. 2 and sent into the nip between the fixing belt 21 and the pressure roller 31, which are pressingly contacted with each other.

By applying heat of the fixing belt 21 heated by the interior member 23, or the heater 25, and pressing forces of the pressure roller 31 and the abutting member 22 onto the unfixed toner image T, the toner image T is fixed on the surface of the recording medium P. The recording medium P is sent out from the nip and is conveyed in a direction indicated by an arrow Y11 in FIG. 2.

As described above, in this example embodiment, the abutting member 22 forming the nip by abutting the pressure roller 31 via the fixing belt 21 serving as a fixing member is provided independent of the interior member 23 disposed so as to face the inner surface of the fixing belt 21 to entirely heat the fixing belt 21 except the nip. Such a configuration may suppress a failure, for example, defective fixing even when the image forming apparatus 1 operates at a relatively high speed with a shortened warm-up or first print time.

As described above, in this example embodiment, the fixing device 20 employs the pressure roller 31 as a pressure member. However, the pressure member may be a pressing belt or pad. In such cases, similar effects to those of this example embodiment may be obtained.

Further, in this example embodiment, the fixing belt 21 having a plurality of layers is employed as the fixing member. However, the fixing member is not limited to the fixing belt 21 but may be an endless fixing film made of polyimide, polyamide, fluorocarbon resin, or metal. In such cases, similar effects to that of this example embodiment may be obtained.

In this example embodiment, the face of the abutting member 22 opposing the heater 25 may be subjected to mirror finishing. Alternatively, a heat insulator may be disposed on the opposing face of the abutting member 22. In such a case, the heat irradiated from the heater 25 toward the abutting member 22 serves to heat the interior member 23. Thus, the heating efficiency of the fixing belt 21 or the interior member 23 may be further enhanced.

Figure 5:
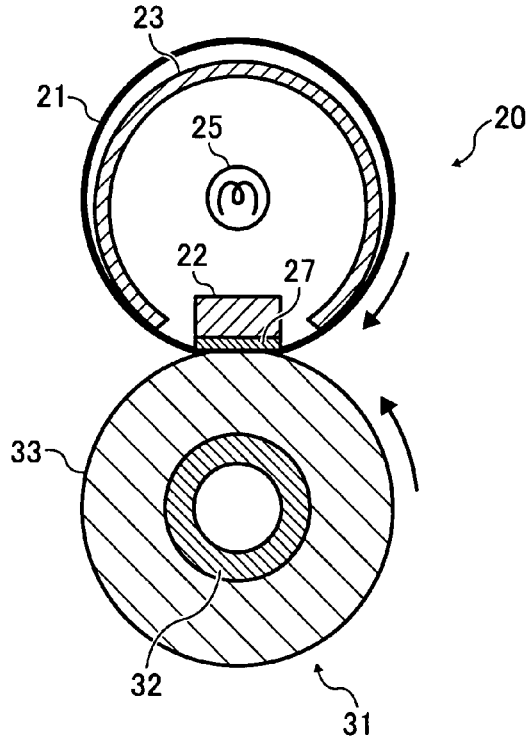
FIG. 5 is a schematic view illustrating a configuration of a fixing device according to an example embodiment.

Next, another example embodiment is described in detail with reference to FIG. 5. FIG. 5 is a schematic view illustrating a configuration of a fixing device 20 according to another example embodiment. FIG. 5 corresponds to FIG. 2 regarding the above-described example embodiment. The fixing device 20 of FIG. 5 is different from the fixing device 20 of FIG. 2 in that an abutting member 22 of FIG. 5 has a substantially cuboid shape and that a heat insulator 27 is disposed between the abutting member 22 and a fixing belt 21.

As illustrated in FIG. 5, the fixing device 20 includes the fixing belt 21 serving as a fixing member, the abutting member 22, an interior member 23, a heater 25, and a pressure roller 31 serving as a pressure member, for example.

In this example embodiment, the abutting member 22 is formed in a substantially cuboid shape unlike the abutting member 22 illustrated in FIG. 2. The abutting member 22 has a flat face opposing the pressure roller 31. Such a configuration may allow a nip between the fixing belt 21 and the pressure roller 31 to be formed in substantially parallel with an image forming surface of a recording medium P. Thus, the coherence between the fixing belt 21 and the recording medium P may be increased, thereby enhancing the fixing of a toner image on the recording medium P. In this configuration, the fixing belt 21 has a relatively large curvature at the exit side of the nip, further facilitating separation of the recording medium P from the fixing belt 21.

In a direction in which the abutting member 22 faces the pressure roller 31 or the heater 25, the abutting member 22 has a larger thickness than that of the interior member 23. Such a configuration allows the abutting member 22, which preferably has a higher strength and/or a larger thickness in order to securely form the nip, and the interior member 23, which preferably has a lower heat capacity or a smaller thickness in order to increase heating efficiency, to be formed independent of each other.

Further, in order to obtain similar effects to the above-described effects, the abutting member 22 may be made of material having relatively high rigidity compared to material of the interior member 23. In other words, the abutting member 22, preferably having a strength enough to securely form the nip, may be made of material having relatively high rigidity, and the interior member 23, preferably having a lower heat capacity in order to increase its heating efficiency, may be made of material having a higher heat conductivity. For example, the interior member 23 may be made of aluminum and the abutting member 22 may be made of stainless steel or iron. In such cases, even when the abutting member 22 and the interior member 23 are formed to have a substantially identical thickness, the fixing device 20 may obtain similar effects to the above-described effects.

In this example embodiment, as illustrated in FIG. 5, the heat insulator 27 is disposed between the abutting member 22 and the fixing belt 21. The heat insulator 27 may be made of silicone foam, heat-resistant felt, or any other suitable material. Such a configuration may suppress reduction in the temperature of the fixing belt 21 and resultant defective fixing that might be caused by the heat transmission from the fixing belt 21 to the abutting member 22 at the nip.

As described above, the abutting member 22 forming the nip by abutting the pressure roller 31 via the fixing belt 21 is provided independent of the interior member 23 disposed so as to face the inner surface of the fixing belt 21 except the nip to heat the fixing belt 21. Such a configuration may suppress a failure, for example, defective fixing even when an image forming apparatus including the fixing device 20 operates at a relatively high speed with a shortened warm-up or first print time.

Next, another example embodiment is described with reference to FIG. 6.

Figure 6:
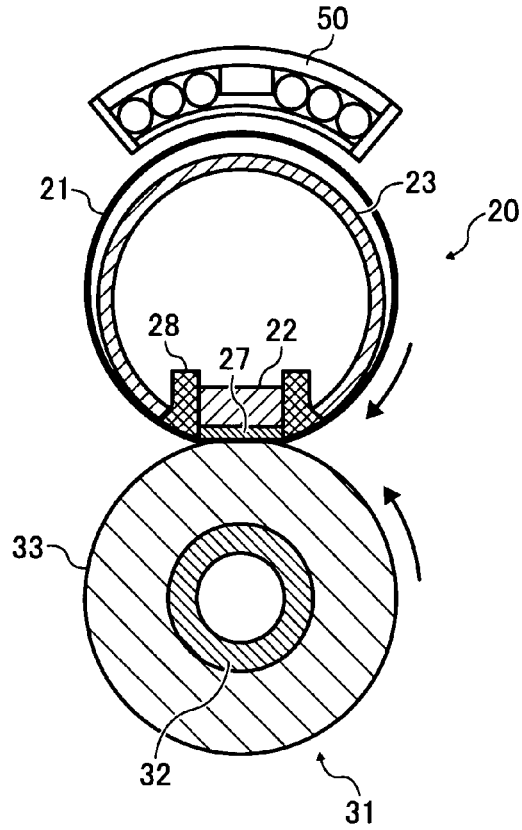
FIG. 6 is a schematic view illustrating a configuration of a fixing device according to an example embodiment.

FIG. 6 is a schematic view illustrating a configuration of a fixing device 20*c* according to another example embodiment. FIG. 6 corresponds to FIG. 5 of the above-described embodiment. The fixing device 20 of FIG. 6 is different from the fixing device 20 of FIG. 5 in that an interior member 23 of FIG. 6 is heated by electromagnetic induction and that heat insulators 28 are provided between an abutting member 22 and the interior member 23.

As illustrated in FIG. 6, the fixing device 20*c* includes a fixing belt 21 serving as a fixing member, the abutting member 22, the interior member 23, and a pressure roller 31 serving as a pressure member, for example.

The fixing device 20 further includes an induction heater 50. The interior member 23 is heated by electromagnetic induction of the induction heater 50 instead of radiation heat of the heat source 25 illustrated in FIG. 5.

The induction heater 50 may include exciting coils, cores, and a coil guide. As illustrated in FIG. 6, the exciting coils may further include litz wires, each having a bundle of fine wires, extending in a width direction of the fixing belt 21 to partially cover the fixing belt 21. The coil guide is made of resin material having relatively high heat resistivity and supports the exciting coils and the cores. The cores are semi-cylindrical members made of ferromagnet, for example, ferrite having a relative permeability of approximately 1000 to 3000, for example. The cores include a central core or side cores in order to efficiently form magnetic flux toward the interior member 23. The cores are disposed so as to face the exciting coils extending in the width direction of the fixing belt 21.

The fixing device 20*c* thus configured operates as follows. When the fixing belt 21 is rotationally driven in the clockwise direction in FIG. 6, the fixing belt 21 is heated at positions facing the induction heater 50. For example, by applying a high-frequency alternating current to the exciting coils, magnetic lines having alternating directions are formed around the interior member 23.

At this time, an eddy current is generated at the surface of the interior member 23 and thus Joule heat is generated by the electrical resistance of the interior member 23. Such Joule heat heats the interior member 23, and the heated interior member 23 heats the fixing belt 21.

Alternatively, in order to efficiently heat the interior member 23 by electromagnetic induction, the induction heater 50 may be disposed so as to face the outer surface of the interior member 23. The interior member 23 may be made of nickel, stainless steel, iron, copper, cobalt, chrome, aluminum, gold, platinum, silver, tin, palladium, or an alloy of at least two of these metals.

In this example embodiment, as illustrated in FIG. 6, the heat insulators 28 are disposed between the abutting member 22 and the interior member 23. The heat insulators 28 may be made of silicone foam, heat-resistant felt, or any other suitable material. Such a configuration may suppress reduction in the heating efficiency of the fixing belt 21 that might be caused by the heat transmission from the interior member 23 to the abutting member 22. In other words, the heat, which would be otherwise transmitted to the abutting member 22, is intensively transmitted to the fixing belt 21. Thus, the fixing belt 21 may be entirely heated except the nip by the interior member 23.

As described above, in this example embodiment, the abutting member 22 forming the nip by abutting the pressure roller 31 via the fixing belt 21 is formed independent of the interior member 23 disposed so as to face the inner surface of the fixing belt 21 except the nip to heat the fixing belt 21. Thus, such a configuration may suppress a failure, for example, defect fixing even when an image forming apparatus including the fixing device 20 operates at a relatively high speed with a shortened warm-up or first print time.

Figure 7:
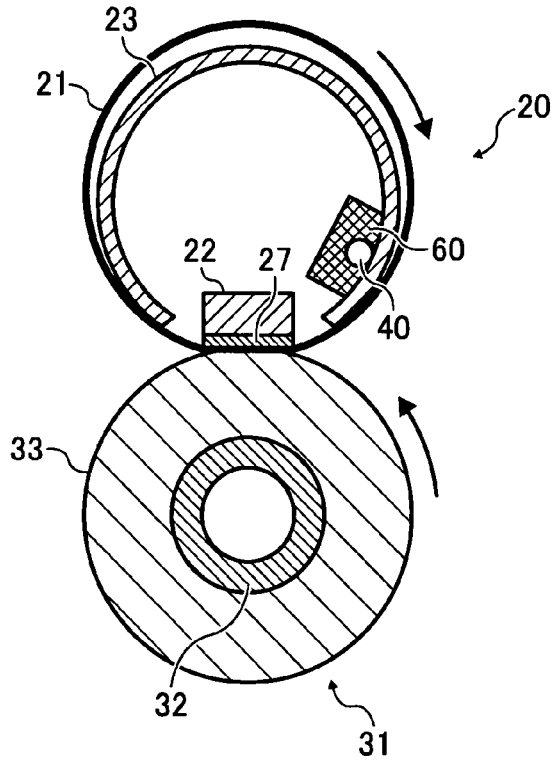
FIG. 7 is a schematic view illustrating a configuration of a fixing device according to an example embodiment.

Next, another example embodiment is described with reference to FIG. 7. FIG. 7 is a schematic view illustrating a fixing device 20 according to another example embodiment. FIG. 7 corresponds to FIG. 5 of the above-described example embodiment. The fixing device 20 of FIG. 7 is different from the fixing device 20 of FIG. 5 in that an interior member 23 of FIG. 7 is heated by heat of a resistance heater 60.

As illustrated in FIG. 7, the fixing device 20 includes a fixing belt 21 serving as a fixing member, an abutting member 22, the interior member 23, a pressure roller 31 serving as a pressure member, and a temperature sensor 40, for example.

In this embodiment, the fixing device 20 further includes the resistance heater 60 provided to the inner surface side of the fixing belt 21. In this example embodiment, the interior member 23 is heated by heat of the resistance heater 60 instead of radiation heat of the heat source 25 as illustrated in FIG. 5.

The resistance heater 60 may be a sheet heating element, for example, a ceramic heater and connected to a power supply, not illustrated, at both end portions thereof. When an electric current is applied to the resistance heater 60, the temperature of the resistance heater 60 is increased by electric resistance thereof, thereby heating the interior member 23 in contact therewith. The interior member 23 thus heated heats the fixing belt 21. Thus, by using the resistance heater 60 as a heat source for heating the interior member 23, the fixing belt 21 may be effectively heated at relatively low cost.

As illustrated in FIG. 7, in this example embodiment, the resistance heater 60 is disposed near the entry of the nip rather than the exit of the nip. Such a configuration may allow the fixing belt 21 to be effectively heated before a relevant portion of the fixing belt 21 reaches the nip.

In this regard, a plurality of resistance heaters 60 may be provided so as to be able to change a heat distribution in the width direction of the fixing belt 21. For example, three resistance heaters 60 may be provided at one central portion and end portions in the width direction of the fixing belt 21. During a normal operation, all the resistance heaters 60 are activated so as to entirely heat the fixing belt 21 or the interior member 23 except the nip.

Alternatively, when a recording medium P having a relatively small size in the width direction of the fixing belt 21 is passed through the nip, only the resistance heater 60 disposed at the central portion of the fixing device 21 is activated to heat the central portion thereof. Thus, even when a plurality of recording media P having a relatively small size in the width direction of the fixing belt 21 are sequentially passed through the nip, the fixing device 20 may suppress excess increase in temperature of each end portion in the width direction of the fixing belt 21.

Further, the resistance heater 60 may preferably have a Curie point temperature, i.e., a temperature at which the resistance value thereof drastically changes so as to stop increase in temperature thereof. In a normal state where the resistance heater 60 does not reach the Curie point temperature, when an electric current is applied to the resistance heater 60, the temperature of the resistance heater 60 is increased, thereby heating the fixing belt 21 or the interior member 23 to a given temperature. On the other hand, when the temperature of the resistance heater 60 reaches the Curie point temperature, the resistance value of the resistance heater 60 rapidly increases, thereby suppressing the flow of the electric current therethrough. When the heat generation of the resistance heater 60 is stopped, an excess increase in temperature of the resistance heater 60 may be prevented.

With this configuration, even when media sheets of a small size are sequentially passed through the nip, the temperature of the fixing belt 21 may be prevented from excessively increasing at the end portions in its width direction.

The Curie point temperature of the resistance heater 60 is preferably set to a given temperature which may not cause an offset on a recording medium. For example, the Curie point temperature of the resistance heater 60 may be set to 180 degrees C.

As described above, in this example embodiment, the abutting member 22 forming the nip by abutting the pressure roller 31 via the fixing belt 21 is provided independent of the interior member 23 disposed so as to face the inner surface of the fixing belt 21 except the nip. Such a configuration may suppress a failure, for example, defective fixing even when an image forming apparatus including the fixing device 20 operates at a relatively high speed with a shortened warm-up time or first print time.

Figure 8:
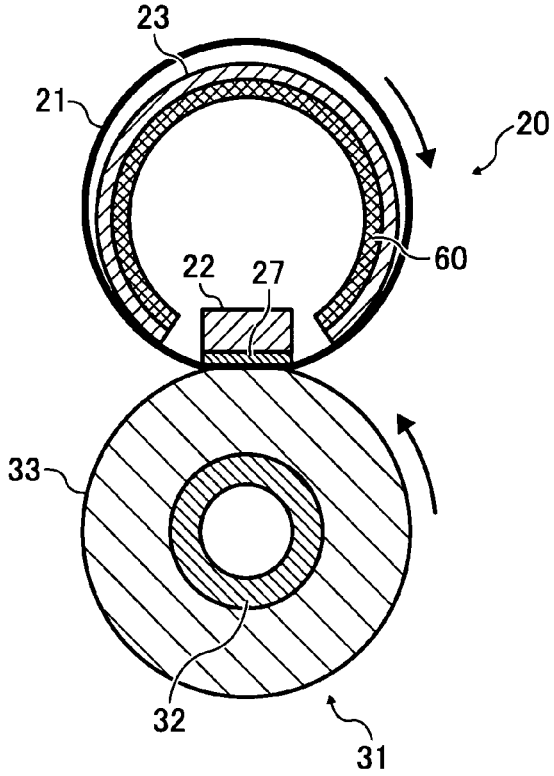
FIG. 8 is a schematic view illustrating a configuration of a fixing device according to an example embodiment.

Next, another example embodiment is described with reference to FIG. 8. FIG. 8 is a schematic view illustrating a fixing device 20 according to another example embodiment. FIG. 8 corresponds to FIG. 7 of the above-described example embodiment. The fixing device 20 of FIG. 8 is different from the fixing device 20 of FIG. 7 in that an inner surface of an interior member 23 of FIG. 8 is entirely, not partially, in contact with a resistance heater 60.

As illustrated in FIG. 8, the fixing device 20 includes a fixing belt 21 serving as a fixing member, an abutting member 22, the interior member 23, a pressure roller 31 serving as a pressure member, and the resistance heater 60, for example.

In this example embodiment, the resistance heater 60 is disposed so as to be in contact with all areas of the inner surface of the interior member 23. Such a configuration allows the interior member 23 to be uniformly heated over all the areas of the inner surface thereof, thereby enhancing the heating efficiency of the fixing belt 21.

In this example embodiment, the resistance heater 60 is employed as a heat source for heating the interior member 23. However, the interior member 23 may be configured as a heat source. Such a configuration may obtain a similar effect to that of this example embodiment.

As described above, in this example embodiment, the abutting member 22 forming the nip by abutting the pressure roller 31 via the fixing belt 21 is provided independent of the interior member 23 disposed so as to face the inner surface of the fixing belt 21 except the nip. Such a configuration may suppress a failure, for example, defective fixing even when an image forming apparatus including the fixing device 20 operates at a relatively high speed with a shortened warm-up time or first print time.

Next, another example embodiment is described with reference to FIG. 9.

Figure 9:
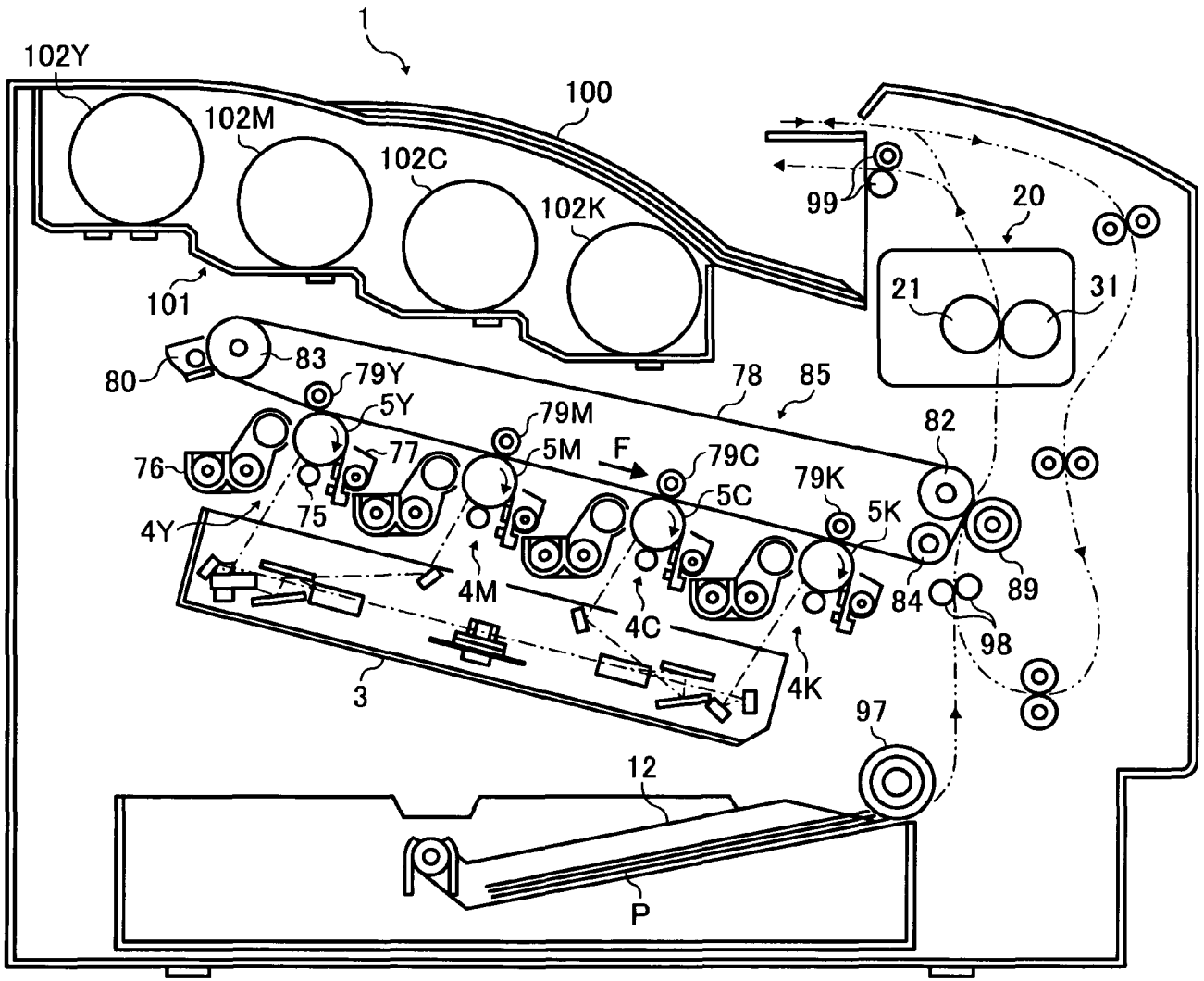
FIG. 9 is a schematic view illustrating an overall configuration of an image forming apparatus according to an example embodiment.

FIG. 9 is a schematic view illustrating an overall configuration of an image forming apparatus 1 including a fixing device 20 according to another example embodiment. The image forming apparatus 1 of FIG. 9 is configured as a color image forming apparatus unlike the image forming apparatus 1 of FIG. 1, which is configured as a monochrome image forming apparatus.

As illustrated in FIG. 9, the image forming apparatus 1 may be a tandem color image forming apparatus. The image forming apparatus 1 includes a bottle casing 101 at an upper portion thereof. In the bottle casing 101 are detachably and replaceably mounted four toner bottles 102Y, 102M, 102C, and 102K containing toner of yellow, magenta, cyan, and black colors, respectively.

Below the bottle casing 101 is provided an intermediate transfer unit 85 including an intermediate transfer belt 78. Imaging units 4Y, 4M, 4C, and 4K for forming images of yellow, magenta, cyan, and black colors are disposed at positions opposing the intermediate transfer belt 78.

The imaging units 4Y, 4M, 4C, and 4K include photoconductor drums 5Y, 5M, 5C, and 5K, respectively. For example, the photoconductor drum 5Y is surrounded by a charger 75, a developing unit 76, a cleaning unit 77, and a discharger, not illustrated. The imaging unit 4Y performs imaging processes including a charging process, an exposing process, a developing process, primary and secondary transfer processes, and a cleaning process, for example. Through the imaging processes, a yellow color image is formed on the photoconductor drums 5Y.

The photoconductor drum 5Y is rotationally driven by a driving motor, not illustrated, in the clockwise direction in FIG. 9. In the charging process, the surface of the photoconductor drum 5Y is uniformly charged by the corresponding charger 75. In the exposing process, the exposing unit 3 emits laser light L onto the surface of the photoconductor drum 5Y to form an electrostatic latent images of yellow color thereon.

In the developing process, when a relevant portion of the surface of the photoconductor drum 5Y reaches a position opposing the developing unit 76, the developing unit 76 develops the electric latent image to form a toner image of yellow color.

In the primary transfer process, when the relevant portion of the photoconductor drum 5Y reaches a position opposing a transfer bias roller 79Y, the yellow toner image on the photoconductor drum 5Y is transferred onto the intermediate transfer belt 78. At this time, a slight amount of untransferred toner may remain on the photoconductor drum 5Y.

In the cleaning process, when the relevant portion of the photoconductor drum 5Y reaches a position opposing the corresponding cleaning unit 77, the untransferred toner is mechanically cleaned by a cleaning blade or any other suitable cleaning member of the cleaning unit 77.

In the discharging process, when the relevant portion of the photoconductor drum 5Y reaches a position opposing the corresponding discharger, the discharger discharges residual charges remaining on the photoconductor drum 5Y. Thus, a series of imaging processes to be performed on the photoconductor drum 5Y is finished.

Similarly, a series of imaging processes is performed on each of the other imaging unit 4M, 4C, and 4K is performed to form toner images of magenta, cyan, and black on the photoconductor drums 5M, 5C, and 5K.

The toner images of respective colors formed on the photoconductor drums 5Y, 5M, 5C, and 5K are transferred in a superimposing manner to form a composite color toner image on the intermediate transfer belt 78.

As illustrated in FIG. 9, the intermediate transfer unit 85 may include the intermediate transfer belt 78, the primary transfer bias rollers 79Y, 79M, 79C, and 79K, a secondary transfer backup roller 82, a cleaning backup roller 83, a tension roller 84, and an intermediate transfer cleaning unit 80. The intermediate transfer belt 78 is extended and supported by the three rollers 82 to 84 and is endlessly moved by rotational driving of the secondary transfer backup roller 82 in a direction indicated by an arrow F in FIG. 9.

The primary transfer bias rollers 79Y, 79M, 79C, and 79K sandwich the intermediate transfer belt 78 with the photoconductor drums 5Y, 5M, 5C, and 5K to form primary transfer nips. Each of the primary transfer bias rollers 79Y, 79M, 79C, and 79K is applied with a transfer bias having a polarity opposite to a polarity of each color toner.

The intermediate transfer belt 78 is moved in the direction indicated by the arrow F so as to sequentially pass through the respective primary transfer nips between the photoconductor drums 5Y, 5M, 5C, and 5K and the primary transfer bias rollers 79Y, 79M, 79C, and 79K. Thus, the respective color toner images on the photoconductor drums 5Y, 5M, 5C, and 5K are transferred on the intermediate transfer belt 78 in a superimposing manner.

Then, the composite color toner image superimposed on the intermediate transfer belt 78 reaches a position facing the secondary transfer roller 89. Meanwhile, the secondary transfer backup roller 82 sandwiches the intermediate transfer belt 78 with the secondary transfer roller 89 to form a secondary transfer nip. The composite color toner image is transferred on a recording medium P conveyed to the secondary transfer nip. At this time, untransferred toner, which has not been transferred onto the recording medium P, may remain on the intermediate transfer belt 78. Such untransferred toner on the intermediate transfer belt 78 is cleaned by the intermediate transfer cleaning unit 80.

Thus, a series of transfer processes to be performed on the intermediate transfer belt 78 is finished.

In this regard, the recording medium P is conveyed from a sheet feeding unit 12, which is disposed at a lower portion of the image forming apparatus 1, via a sheet feeding roller 97, a pair of registration rollers 98, and other rollers.

The sheet feeding unit 12 accommodates a stack of recording media P, for example, transfer sheets. When the sheet feeding roller 97 is rotationally driven in the counterclockwise direction in FIG. 9, a topmost one of the recording media P is fed between the pair of registration rollers 98.

The recording medium P conveyed to the pair of registration rollers 98 is temporarily stopped at a roller nip between the pair of registration rollers 98. The pair of registration rollers 98 are rotationally driven to convey the recording medium P to the secondary transfer nip at such a timing that the color image on the intermediate transfer belt 78 is transferred onto the recording medium P. Thus, the desired color image is appropriately transferred on the recording medium P.

When the recording medium P having the color image transferred is conveyed to the fixing device 20, the fixing device 20 fixes the color image on the recording medium P. In this example embodiment, the fixing device 20 of FIG. 9 is similar in configuration and operation to the fixing device 20 of FIG. 2. In other words, in the fixing device 20 of FIG. 9, the abutting member 22 forming the nip by abutting the pressure roller 31 via the fixing belt 21 is provided independent of the interior member 23 disposed so as to face the inner surface of the fixing belt 21 except the nip to heat the fixing belt 21.

The recording medium P is passed through a nip of a pair of ejection rollers 99 and is ejected to the outside of the image forming apparatus 1. The ejected recording medium P having the desired color image is stacked on a stack portion 100. Thus, a series of image forming processes of the image forming apparatus 1 is completed.

As described above, in this example embodiment, the abutting member 22 forming the nip by abutting the pressure roller 31 via the fixing belt 21 is provided independent of the interior member 23 disposed so as to face the inner surface of the fixing belt 21 except the nip to heat the fixing belt 21. Such a configuration may suppress a failure, for example, defective fixing even when an image forming apparatus including the fixing device 20 operates at a relatively high speed with a shortened warm-up or first print time.

Numerous additional modifications and variations are possible in light of the above teachings. It is therefore to be understood that, within the scope of the appended claims, the disclosure of this application may be practiced otherwise than as specifically described herein.

Further, elements and/or features of different example embodiments and/or examples may be combined with each other and/or substituted for each other within the scope of this disclosure and appended claims.

Example embodiments and/or examples being thus described, it should be apparent to one skilled in the art after reading this disclosure that the example embodiments and examples may be varied in many ways. Such variations are not to be regarded as a departure from the spirit and scope of the present disclosure, and such modifications are not excluded from the scope of the following claims.

What is claimed is:

1. A fixing device, comprising:

a flexible fixing member, formed in an endless shape, to heat and melt a toner image;

a pressure member disposed to be in contact with the fixing member with pressure;

an abutting member, fixedly disposed at the inner surface side of the fixing member so as to form a nip portion by abutting the pressure member via the fixing member, the abutting member including a sliding contact face to slidingly contact the flexible fixing member;

an interior member, fixedly disposed so as to face at least a portion of the inner surface of the fixing member except the nip portion, to heat the fixing member, the abutting member and the interior member being provided independent of each other, wherein the interior member is configured to be in sliding contact with the inner surface of the fixing member; and a heat insulator disposed between the abutting member and the interior member.

2. The fixing device according to claim 1, wherein the abutting member is made of material having a higher rigidity than material of the interior member.

3. The fixing device according to claim 1, wherein the abutting member is formed thicker than the interior member.

4. The fixing device according to claim 1, wherein the abutting member and the interior member are disposed apart from each other.

5. The fixing device according to claim 1, further comprising a heat insulator disposed between the abutting member and the fixing member.

6. The fixing device according to claim 1, further comprising a heat source to heat the interior member by radiation heat of the heat source.

7. The fixing device according to claim 1, wherein the interior member is heated by electromagnetic induction.

8. The fixing device according to claim 1, further comprising a resistance heater to heat the interior member.

9. The fixing device according to claim 8, wherein the resistance heater includes a plurality of resistance heating elements disposed so as to change a heat distribution in a width direction of the fixing member.

10. The fixing device according to claim 8, wherein the resistance heater has a given Curie point temperature.

11. The fixing device according to claim 1, wherein the interior member is a resistance heater.

12. The fixing device according to claim 1, wherein the fixing member is a fixing belt.

13. The fixing device according to claim 1, wherein the fixing member is a fixing film.

14. The fixing device according to claim 1, wherein the interior member is made of a metal having a given level of heat conductivity.

15. The fixing device according to claim 1, wherein the abutting member is fixedly disposed so as to prevent a rotation of the abutting member about its axis.

16. An image forming apparatus, comprising a fixing device to fix a toner image on a recording medium, the fixing device including:

a flexible fixing member, formed in an endless shape, to heat and melt a toner image;

a pressure member disposed to be in contact with the fixing member with pressure;

an abutting member, fixedly disposed at the inner surface side of the fixing member so as to form a nip portion by abutting the pressure member via the fixing member, the abutting member including a sliding contact face to slidingly contact the flexible fixing member;

an interior member, fixedly disposed so as to face at least a portion of the inner surface of the fixing member except the nip portion, to heat the fixing member, the abutting member and the interior member being provided independent of each other, wherein the interior member is configured to be in sliding contact with the inner surface of the fixing member; and a heat insulator disposed between the abutting member and the interior member.

17. The image forming apparatus according to claim 16, wherein the abutting member of the fixing device is made of material having a higher rigidity than material of the interior member.

18. The image forming apparatus according to claim 16, wherein the abutting member of the fixing device is formed thicker than the interior member.

19. The image forming apparatus according to claim 16, wherein the abutting member and the interior member of the fixing device are disposed apart from each other.

20. An image forming apparatus, comprising:

a fixing device to fix a toner image on a recording medium, the fixing device including a flexible fixing member, formed in an endless shape, to heat and melt a toner image, a pressure member disposed to be in contact with the fixing member with pressure, an abutting member, fixedly disposed at the inner surface side of the fixing member so as to form a nip portion by abutting the pressure member via the fixing member, the abutting member including a sliding contact face to slidingly contact the flexible fixing member, an interior member, fixedly disposed so as to face at least a portion of the inner surface of the fixing member except the nip portion, to heat the fixing member, the abutting member and the interior member being provided independent of each other, an induction heater, disposed outside the fixing member, to heat the interior member by induction heating, wherein the interior member is configured to be in sliding contact with the inner surface of the fixing member; and a heat insulator between the interior member and the abutting member.

21. The image forming apparatus according to claim 20, wherein the induction heater comprises an exciting coil to create magnetic flux and a coiled guide to hold the exciting coil.

22. The image forming apparatus according to claim 20, wherein the interior member is made of an alloy of at least two types of metals.

23. The image forming apparatus according to claim 20, wherein the abutting member and the interior member are disposed apart from each other.

24. The image forming apparatus according to claim 20, further comprising:

a heat insulator disposed between the abutting member and the fixing member.

25. The image forming apparatus according to claim 20, wherein the interior member is made of a metal having a given level of heat conductivity.

26. The image forming apparatus according to claim 20, wherein the abutting member has a face opposite to the pressure member and the face has a curvature similar to a curvature of the pressure member.

* * * * *